US012384644B2

(12) United States Patent
Kishimoto

(10) Patent No.: US 12,384,644 B2
(45) Date of Patent: Aug. 12, 2025

(54) SHEET POST-PROCESSING DEVICE

(71) Applicant: KYOCERA Document Solutions Inc., Osaka (JP)

(72) Inventor: Tadahisa Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 166 days.

(21) Appl. No.: 18/463,803

(22) Filed: Sep. 8, 2023

(65) Prior Publication Data

US 2024/0092600 A1 Mar. 21, 2024

(30) Foreign Application Priority Data

Sep. 16, 2022 (JP) ..... 2022-148428

(51) Int. Cl.
*B65H 29/52* (2006.01)
*B65H 31/26* (2006.01)

(52) U.S. Cl.
CPC ..... *B65H 31/26* (2013.01); *B65H 29/52* (2013.01); *B65H 2404/693* (2013.01); *B65H 2405/11151* (2013.01); *B65H 2511/212* (2013.01); *B65H 2801/06* (2013.01); *B65H 2801/27* (2013.01)

(58) Field of Classification Search
CPC ..... B65H 29/52; B65H 31/26
See application file for complete search history.

(56) References Cited

U.S. PATENT DOCUMENTS

| | | | | |
|---|---|---|---|---|
| 10,221,031 | B2 * | 3/2019 | Endo | B65H 31/02 |
| 2017/0248888 | A1 * | 8/2017 | Izumichi | B65H 31/02 |
| 2019/0144221 | A1 * | 5/2019 | Lo | B65H 31/02 271/30.1 |
| 2024/0101385 | A1 * | 3/2024 | Murata | B65H 31/02 |
| 2024/0286862 | A1 * | 8/2024 | Kishimoto | B65H 31/26 |

FOREIGN PATENT DOCUMENTS

JP 2002-255431 9/2002

* cited by examiner

*Primary Examiner* — Patrick Cicchino
(74) *Attorney, Agent, or Firm* — Stein IP, LLC

(57) ABSTRACT

The sheet post-processing device includes a discharge port, a discharge tray, a first sheet holding member, and a second sheet holding member. The discharge port has a pair of discharge rollers that discharge a sheet including a folded sheet subjected to folding processing. The first sheet holding member and the second sheet holding member are, on a downstream side of the pair of discharge rollers in the discharge direction of the folded sheet, selectively disposed at a holding position, at which the first sheet holding member and the second sheet holding member intersect a discharge route for the folded sheet and extend downward from above the pair of discharge rollers toward the discharge tray to hold the folded sheet, and a retreat position retreated to above the discharge route for the folded sheet.

4 Claims, 8 Drawing Sheets

SHEET POST-PROCESSING DEVICE

INCORPORATION BY REFERENCE

This application is based on and claims the benefit of priority from Japanese Patent Application No. 2022-148428 filed on Sep. 16, 2022, the contents of which are hereby incorporated by reference.

BACKGROUND

The present disclosure relates to a sheet post-processing device that performs post-processing with respect to a sheet having had an image formed thereon by an image forming apparatus.

A known sheet post-processing device performs folding processing of forming a fold in a sheet having had an image formed thereon by an image forming apparatus such as a copier, a printer, or the like. In a case where sheets subjected to such folding processing are discharged to be stacked on a discharge tray, the folded-parts of the sheets make the stack of the sheets partly thick, and thus it is difficult to stack a large number of such sheets in an aligned manner. Measures have conventionally been taken to deal with this inconvenience.

SUMMARY

According to one aspect of the present disclosure, a sheet post-processing device includes a discharge port, a discharge tray, a first sheet holding member, and a second sheet holding member. The discharge port has a pair of discharge rollers that discharge a folded sheet subjected to folding processing. On the discharge tray, the sheet discharged through the discharge port is stacked. The first sheet holding member is attached above the pair of discharge rollers, and holds the folded sheet stacked on the discharge tray by an upstream end part of the folded sheet in a discharge direction of the folded sheet. The second sheet holding member is attached above the pair of discharge rollers, and holds the folded sheet stacked on the discharge tray by a downstream end part of the folded sheet in the discharge direction of the folded sheet. The first sheet holding member and the second sheet holding member are, on a downstream side of the pair of discharge rollers in the discharge direction of the folded sheet, selectively disposed at a holding position, at which the first sheet holding member and the second sheet holding member intersect a discharge route for the folded sheet and extend downward from above the pair of discharge rollers toward the discharge tray to hold the folded sheet, and at a retreat position retreated to above the discharge route for the folded sheet.

DETAILED DESCRIPTION

Embodiments of the present disclosure will be described below with reference to the accompanying drawings. It should be understood, however, that the present disclosure is not limited to what is specifically described below.

Figure 1:
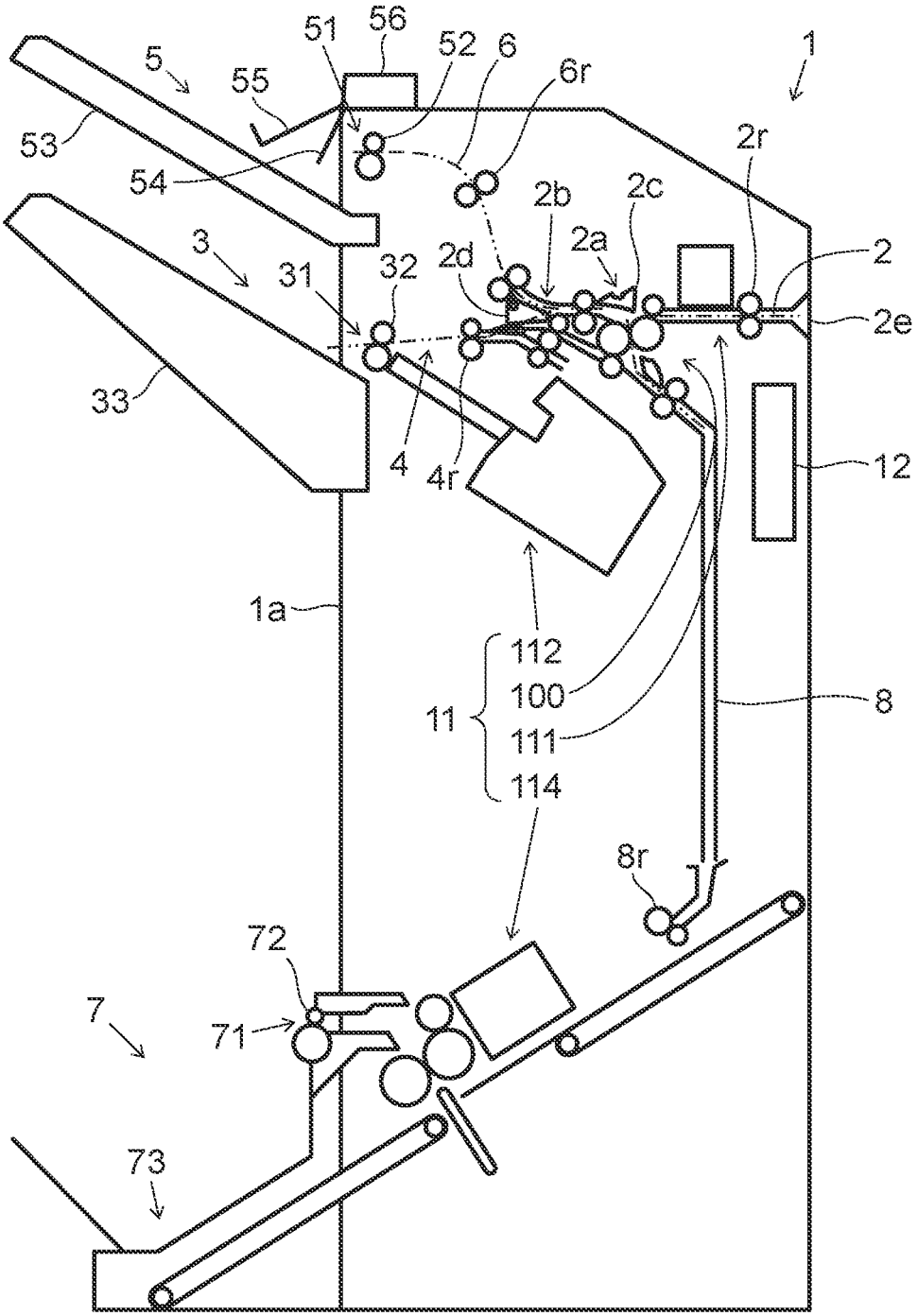
FIG. 1 is a schematic sectional front view of a sheet post-processing device according to one embodiment of the present disclosure.

FIG. 1 is a schematic sectional front view of a sheet post-processing device 1 according to one embodiment. The sheet post-processing device 1 is attachably/detachably coupled to a side face of, for example, an image forming apparatus (unillustrated). The sheet post-processing device 1 performs post-processing with respect to a sheet having had an image formed (printed) thereon by the image forming apparatus.

As shown in FIG. 1, the sheet post-processing device 1 includes a sheet introduction path 2, a first sheet discharge portion 3, a first sheet discharge path 4, a second sheet discharge portion 5, a second sheet discharge path 6, a third sheet discharge portion 7, a third sheet discharge path 8, a post-processing portion 11, and a post-processing control portion (a control portion) 12.

The sheet introduction path 2 has a sheet introduction port 2*e*. The sheet introduction port 2*e* is provided in a side face of the sheet post-processing device 1, the side face facing the image forming apparatus (not shown). A sheet conveyed from the image forming apparatus toward the sheet post-processing device 1 passes through the sheet introduction port 2*e* and the sheet introduction path 2 to be introduced into the sheet post-processing device 1.

The sheet introduction path 2 substantially horizontally extends from the sheet introduction port 2*e* to a sheet folding portion 100, which will be described later, in a direction (a leftward direction in FIG. 1) away from the image forming apparatus. In this description, a direction from the sheet introduction port 2*e* toward an inside of the sheet post-processing device 1 is referred to as a sheet conveyance direction along the sheet introduction path 2. The sheet introduction port 2*e* is located at an upstream end of the sheet introduction path 2 in the sheet conveyance direction. In the sheet introduction path 2, pairs of feed rollers 2*r* are disposed.

The pairs of feed rollers 2*r* convey, on the sheet introduction path 2, a sheet introduced through the sheet introduction port 2*e* into the sheet post-processing device 1, toward a downstream side in the sheet conveyance direction.

The sheet introduction path 2 has a first branching portion 2*a* and a second branching portion 2*b*. The first branching portion 2*a* is located upstream of the second branching portion 2*b* with respect to the sheet conveyance direction along the sheet introduction path 2. The second branching portion 2*b* is located at a downstream end part of the sheet introduction path 2 in the sheet conveyance direction.

At the first branching portion 2*a*, a first switching guide 2*c* is disposed. The first switching guide 2*c* switches a conveyance direction of a sheet conveyed on the sheet introduction path 2 from a side of the sheet introduction port 2*e* toward the downstream side in the sheet conveyance direction between a direction leading to the first sheet discharge portion 3 and the second sheet discharge portion 5 and a direction leading to the third sheet discharge portion 7.

At the second branching portion 2*b*, a second switching guide 2*d* is disposed. The second switching guide 2*d* switches the conveyance direction of the sheet conveyed on the sheet introduction path 2 from the side of the sheet introduction port 2*e* toward the downstream side in the sheet conveyance direction between a direction leading to the first sheet discharge portion 3 and a direction leading to the second sheet discharge portion 5.

The first sheet discharge portion 3 is provided on a side face 1*a* of the sheet post-processing device 1, the side face 1*a* being located opposite the side face of the sheet post-processing device 1 that faces the image forming apparatus. The first sheet discharge portion 3 has a first discharge port 31, a pair of first discharge rollers 32, and a first discharge tray 33.

The first discharge port 31 is located at a downstream end of the first sheet discharge path 4 in the sheet conveyance direction. The pair of first discharge rollers 32 are disposed at the first discharge port 31. The first discharge tray 33 is located downstream of the first discharge port 31 in the sheet conveyance direction. A sheet having been conveyed along the first sheet discharge path 4 to reach the first discharge port 31 is discharged, by the pair of first discharge rollers 32, through the first discharge port 31 onto the first discharge tray 33. The first discharge tray 33 is one of final discharge destinations of sheets subjected to the post-processing performed by the sheet post-processing device 1.

The first sheet discharge path 4 is continuous with the downstream end of the sheet introduction path 2 in the sheet conveyance direction, and substantially horizontally extends to the first sheet discharge portion 3 in the direction (the leftward direction in FIG. 1) away from the image forming apparatus. In this description, a direction (the leftward direction in FIG. 1) from the inside of the sheet post-processing device 1 toward the first discharge portion 3 is referred to as a sheet conveyance direction along the first sheet discharge path 4. In the first sheet discharge path 4, pairs of feed rollers 4*r* are disposed. The pairs of feed rollers 4*r* convey a sheet having passed through the sheet introduction path 2 to reach the second branching portion 2 toward a downstream side on the first sheet discharge path 4 in the sheet conveyance direction, that is, toward the first sheet discharge portion 3.

The second sheet discharge portion 5 is provided on the side face 1*a* of the sheet post-processing device 1 located opposite the side face thereof facing the image forming apparatus, above the first sheet discharge portion 3. The second sheet discharge portion 5 has a second discharge port (a discharge port) 51, a pair of second discharge rollers (a pair of discharge rollers) 52, and a second discharge tray (a discharge tray) 53.

The second discharge port 51 is located at a downstream end of the second sheet discharge path 6 in the sheet conveyance direction. The pair of second discharge rollers 52 are disposed at the second discharge port 51. The second discharge tray 53 is located downstream of the second discharge port 51 in the sheet conveyance direction. A sheet having been conveyed through the second sheet discharge path 6 to reach the second discharge port 51 is discharged, by the pair of second discharge rollers 52, through the second discharge port 51 onto the second discharge tray 53. The second discharge tray 53 is one of the final discharge destinations of sheets subjected to the post-processing performed by the sheet post-processing device 1.

The second sheet discharge path 6 branches off from the second branching portion 2 located at a downstream part of the sheet introduction path 2 in the sheet conveyance direction, and the second sheet discharge path 6 extends not only laterally in the direction (the leftward direction in FIG. 1) away from the image forming apparatus but also in an upward direction to the second sheet discharge portion 5. In this description, a direction (an upper-leftward direction in FIG. 1) from the second branching portion 2*b* toward the second sheet discharge portion 5 is referred to as a sheet conveyance direction along the second sheet discharge path 6. In the second sheet discharge path 6, pairs of feed rollers 6*r* are disposed. The pairs of feed rollers 6*r* convey a sheet having passed through the sheet introduction path 2 to reach the second branching portion 2 toward a downstream side on the second sheet discharge path 6 in the sheet conveyance direction, that is, toward the second sheet discharge portion 5.

The third sheet discharge portion 7 is provided on the side face 1*a* of the sheet post-processing device 1 located opposite the side face thereof facing the image forming apparatus, below the first sheet discharge portion 3. In other words, the third sheet discharge portion 7 is disposed near a bottom portion of the sheet post-processing device 1. The third sheet discharge portion 7 has a third discharge port 71, a pair of third discharge rollers 72, and a third discharge tray 73.

The third discharge port 71 is located at a downstream end of the third sheet discharge path 8 in the sheet conveyance direction. The pair of third discharge rollers 72 are disposed at the third discharge port 71. The third discharge tray 73 is located downstream of the third discharge port 71 in the sheet conveyance direction. A sheet having been conveyed through the third sheet discharge path 8 to reach the third discharge port 71 is discharged, by the pair of third discharge rollers 72, through the third discharge port 71 onto the third discharge tray 73. The third discharge tray 73 is one of the final discharge destinations of sheets subjected to the post-processing performed by the sheet post-processing device 1.

The third sheet discharge path 8 branches off from the first branching portion 2*a* located at the downstream part of the sheet introduction path 2 in the sheet conveyance direction, and extends in a downward direction to the third sheet discharge portion 7. In this description, a direction from the first branching portion 2*a* toward the third sheet discharge portion 7 is referred to as a sheet conveyance direction along the third sheet discharge path 8. In the third sheet discharge path 8, pairs of feed rollers 8*r* are disposed. The pairs of feed rollers 8*r* convey a sheet having passed through the sheet introduction path 2 to reach the first branching portion 1 toward a downstream side on the third sheet discharge path 8 in the sheet conveyance direction, that is, toward the third sheet discharge portion 7.

The post-processing portion 11 performs the predetermined post-processing with respect to a sheet having been subjected to image formation performed by the image forming apparatus and introduced into the sheet post-processing device 1. The post-processing portion 11 includes a punching portion 111, a stapling portion 112, a sheet folding portion 100, and a book-binding portion 114.

The punching portion 111 is disposed in the sheet introduction path 2, closely downstream of the sheet introduction port 2*e*. The punching portion 111 is capable of performing punching processing with respect to a sheet conveyed on the sheet introduction path 2, thereby to form a punch hole in the sheet.

The stapling portion 112 is disposed below the first sheet discharge path 4, in the vicinity of the first sheet discharge portion 3. The stapling portion 112 is capable of performing stapling processing (binding processing) with respect to a bundle of sheets formed by stacking together a plurality of sheets, thereby to bind the bundle of sheets.

The sheet folding portion 100 is disposed, with respect to the sheet conveyance direction along the sheet introduction path 2, downstream of the punching portion 111, upstream of the stapling portion 112. The sheet folding portion 100 is capable of performing folding processing with respect to a single sheet, thereby to make a fold in the single sheet.

Figure 2A:
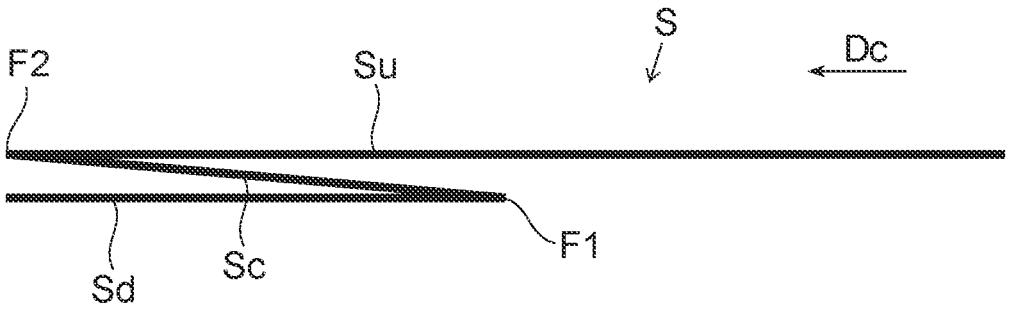
FIG. 2A is a schematic front view of a Z-folded sheet.
Figure 2B:
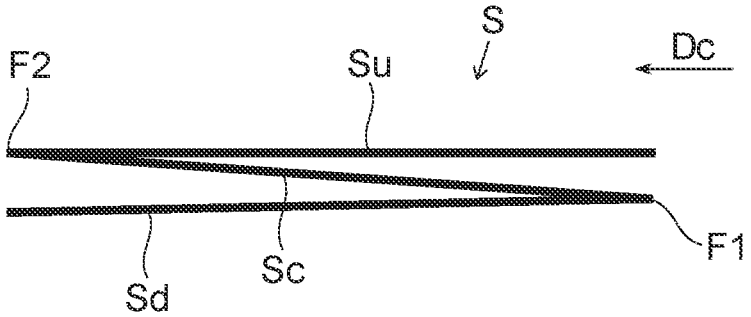
FIG. 2B is a schematic front view of an outward triple-folded sheet.
Figure 2C:
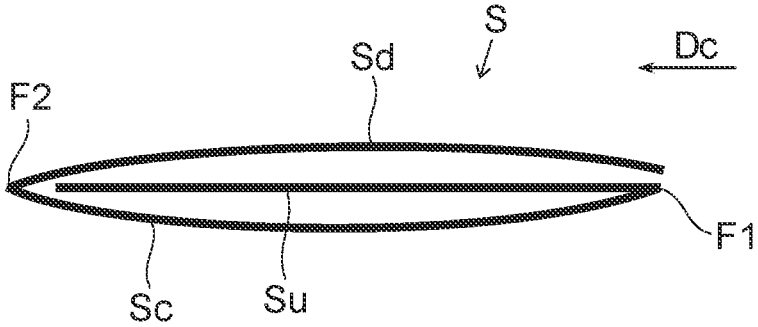
FIG. 2C is a schematic front view of an inward triple-folded sheet.

The sheet folding portion 100 is capable of performing, with respect to a single sheet, processing such as double-folding, Z-folding, outward triple-folding, inward triple-folding, quadruple-folding, etc. FIGS. 2A, 2B, and 2C are schematic front views of a Z-folded sheet S, an outward triple-folded sheet S, and an inward triple-folded sheet S, respectively.

Z-folding is a manner of folding in which, as shown in FIG. 2A for example, a downstream part of a sheet S with respect to the sheet conveyance direction Dc along the sheet introduction path 2 is formed into a Z-shape as seen from a sheet width direction (the depth direction of the plane of FIG. 2A) orthogonal to the sheet conveyance direction. In Z folding, a downstream part Sd of the sheet S downstream of a first fold F1 in the sheet conveyance direction Dc and an upstream part Su of the sheet S upstream of a second fold F2 face each other in an up-down direction across a middle part Sc of the sheet S between the two folds. In the sheet conveyance direction Dc, the downstream part Sd and the middle part Sc of the sheet S are approximately equal in length, but are shorter than the upstream part Su in length.

Outward triple-folding is a manner of folding in which, as shown in FIG. 2B for example, an entire sheet S is formed into a Z-shape as seen from the sheet width direction (the depth direction of the plane of FIG. 2B). In outward triple-folding, a downstream part Sd of the sheet S downstream of a first fold F1 in the sheet conveyance direction Dc and an upstream part Su of the sheet S upstream of a second fold F2 face each other in the up-down direction across a middle part Sc of the sheet S between the two folds. In the sheet conveyance direction Dc, the downstream part Sd, the middle part Sc, and the upstream part Su of the sheet S are approximately equal in length.

In inward triple-folding, as shown in FIG. 2C for example, an upstream part Su of a sheet S upstream of a first fold F1 in the sheet conveyance direction Dc and a downstream part Sd of the sheet S downstream of a second fold F2 face each other in the up-down direction and make surface contact with each other at one side of (in FIG. 2C, above) the plane of a middle part Sc of the sheet S between the two folds.

In this description, a sheet having been subjected to the folding processing may be referred to as a "folded sheet."

The book-binding portion 114 is disposed in a downstream part of the third sheet discharge path 8 in the sheet conveyance direction, in the vicinity of the third sheet discharge portion 7. The book-binding portion 114 is capable of performing, with respect to a bundle of sheets formed by stacking a plurality of sheets, middle-folding processing and middle-binding processing in which the book-binding portion 114 folds and binds the bundle of sheets substantially at its middle, thereby to form a booklet.

The post-processing control portion 12 includes a CPU, an image processor, a storage, and other electronic circuits and electronic components (of which none is shown). The post-processing control portion 12 is communicably connected to a main control portion of the image forming apparatus (unillustrated). The post-processing control portion 12 receives instructions from the main control portion, and by means of the CPU and based on a control program and control data stored in the storage, controls operations of various components provided in the sheet post-processing device 1 so as to perform processing related to functions of the sheet conveyance device 1. The sheet introduction path 2, the first sheet discharge portion 3, the first sheet discharge path 4, the second sheet discharge portion 5, the second sheet discharge path 6, the third sheet discharge portion 7, the third sheet discharge path 8, and the post-processing portion 11 individually receive instructions from the post-processing control portion 12 to cooperate so as to perform post-processing on sheets. The functions of the post-processing control portion 12 may be assumed by the main control portion of the image forming apparatus.

Figure 3:
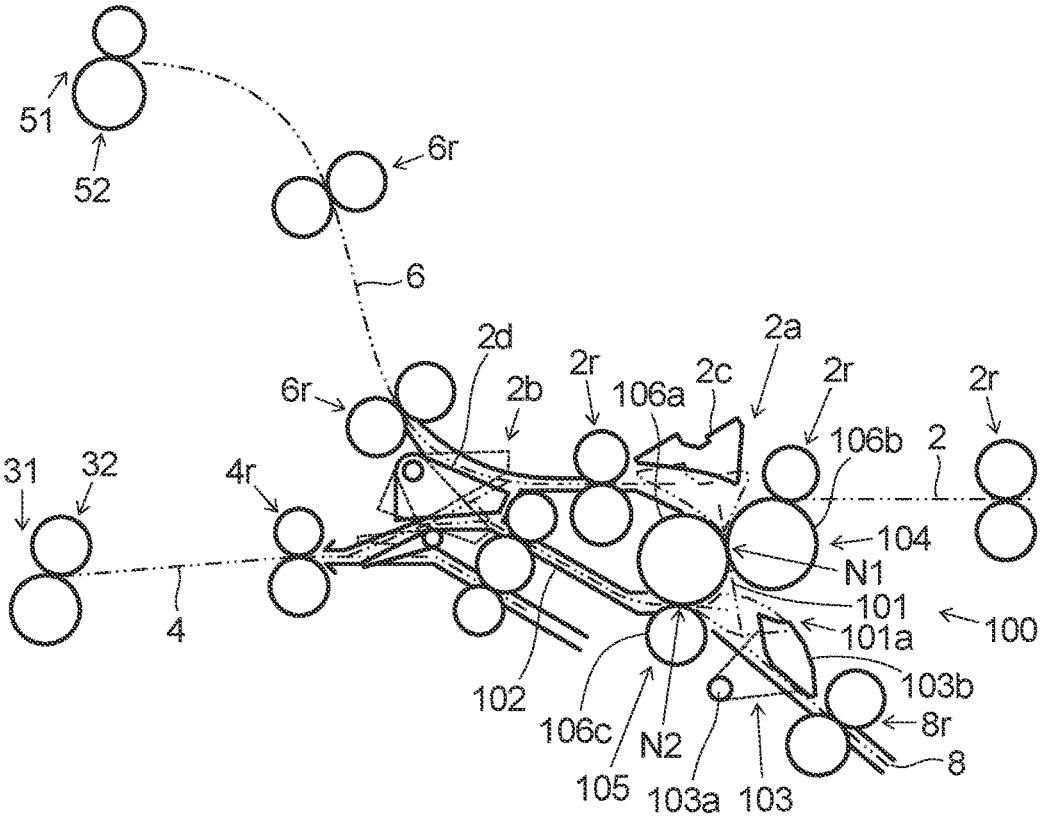
FIG. 3 is a partial sectional front view showing a sheet folding portion of the sheet post-processing device and its vicinity shown in FIG. 1.

Next, a configuration of the sheet folding portion 100 will be described with reference to FIG. 3. FIG. 3 is a partial sectional front view showing the sheet folding portion 100 of the sheet post-processing device 1 and its vicinity shown in FIG. 1. The sheet folding portion 100 includes a first sheet conveyance path 101, a second sheet conveyance path 102, and a folding blade 103.

The first sheet conveyance path 101 is configured as an upstream part of the third sheet discharge path 8 in the sheet conveyance direction. That is, the first sheet conveyance path 101 branches off from the first branching portion 2*a* which is on the sheet introduction path 2, and extends in a direction toward where the third sheet discharge portion 7 is located, in a downward direction in FIG. 3. Along the first sheet conveyance path 101, a sheet is conveyed.

The second sheet conveyance path 102 branches off from a folding branching portion 101*a* which is on the first sheet conveyance path 101, and extends in a direction for intersecting the first sheet conveyance path 101. The second sheet conveyance path 102 extends from the folding branching portion 101*a* toward a side-face-la side part of the sheet post-processing device 1 where the first sheet discharge path 4 is provided, in a leftward direction in FIG. 3. Along the second sheet conveyance path 102, a sheet is conveyed. A downstream end of the second sheet conveyance path 102 in the sheet conveyance direction merges with the second branching portion 2b.

The folding blade 103 is disposed in the vicinity of the folding branching portion 101a which is on the first sheet conveyance path 101. The folding blade 103 has a swing support shaft 103a and a blade portion 103b. The swing support shaft 103a and the blade portion 103b are located, as seen from the sheet width direction (the depth direction of the plane of FIG. 3) orthogonal to the sheet conveyance direction, at positions opposite each other across a sheet conveyance region of the first sheet conveyance path 101, the sheet conveyance region being downstream of the folding branching portion 101a.

The swing support shaft 103a extends in a direction parallel to the sheet width direction. The folding blade 103 swings about an axis of the swing support shaft 103a clockwise or counterclockwise in FIG. 3. Specifically, the folding blade 103 is swingable so as to be disposed at a first position (see FIG. 3) for guiding a sheet conveyed on the first sheet conveyance path 101 to a downstream part of the first sheet conveyance path 101 in the sheet conveyance direction and a second position (see FIG. 6) for guiding a sheet conveyed on the first sheet conveyance path 101 to the second sheet conveyance path 102.

Further, the sheet folding portion 100 includes a pair of first conveyance rollers 104 and a pair of second conveyance rollers 105.

The pair of first conveyance rollers 104 are disposed, with respect to the sheet conveyance direction along the first sheet conveyance path 101, at a downstream part of the first branching portion 2a. The pair of first conveyance rollers 104 conveys a sheet on the first sheet conveyance path 101 in a direction away from the first branching portion 2a. The pair of first conveyance rollers 104 are constituted of a first roller 106a and a second roller 106b. The first roller 106a and the second roller 106b are disposed opposite each other across the sheet conveyance region of the first sheet conveyance path 101, and thereby form a first nip portion N1.

The first switching guide 2c is disposed opposite the first nip portion N1 across a sheet conveyance region of the sheet introduction path 2. The first switching guide 2c is reciprocatable in directions toward and away from the first nip portion N1.

The first switching guide 2c approaches the first nip portion N1 before a sheet conveyed on the sheet introduction path 2 reaches the first branching portion 2a, thereby to guide the sheet to the first nip portion N1, thus switching the conveyance direction of the sheet to direct the sheet into the first sheet conveyance path 101 (the third sheet discharge path 8). Further, the first switching guide 2c can press such part of a sheet conveyed on the sheet introduction path 2 as has stopped over the first branching portion 2a and corresponds to a fold toward the first nip portion N1, and thus can also be used as a folding blade that performs folding processing on the sheet.

The second roller 106b is also used as one of the rollers that constitute one of the pairs of feed rollers 2r on the sheet introduction path 2.

The pair of second conveyance rollers 105 are disposed in a downstream part of the folding branching portion 101a with respect to the sheet conveyance direction along the second sheet conveyance path 102. The pair of second conveyance rollers 105 convey a sheet on the second sheet conveyance path 102 in a direction away from the folding branching portion 101a. The pair of second conveyance rollers 105 are constituted of the first roller 106a and a third roller 106c. The first roller 106a and the third roller 106c are disposed opposite each other across a sheet conveyance region of the second sheet conveyance path 102, and thereby form a second nip portion N2.

The folding blade 103 is disposed opposite the second nip portion N2 across the sheet conveyance region of the first sheet conveyance path 101. The folding blade 103 is reciprocatable in directions toward and away from the second nip portion N2.

The folding blade 103 approaches the second nip portion N2 before a sheet conveyed on the first sheet conveyance path 101 reaches the folding branching portion 101a, thereby to guide the sheet to the second nip portion N2, thus switching the conveyance direction of the sheet to direct the sheet into the second sheet conveyance path 102. The folding blade 103 press such part of a sheet conveyed on the first sheet conveyance path 101 as has stopped over the folding branching portion 101a and corresponds to a fold and toward the second nip portion N2, and thereby performs folding processing on the sheet to form a fold therein.

Figure 4:
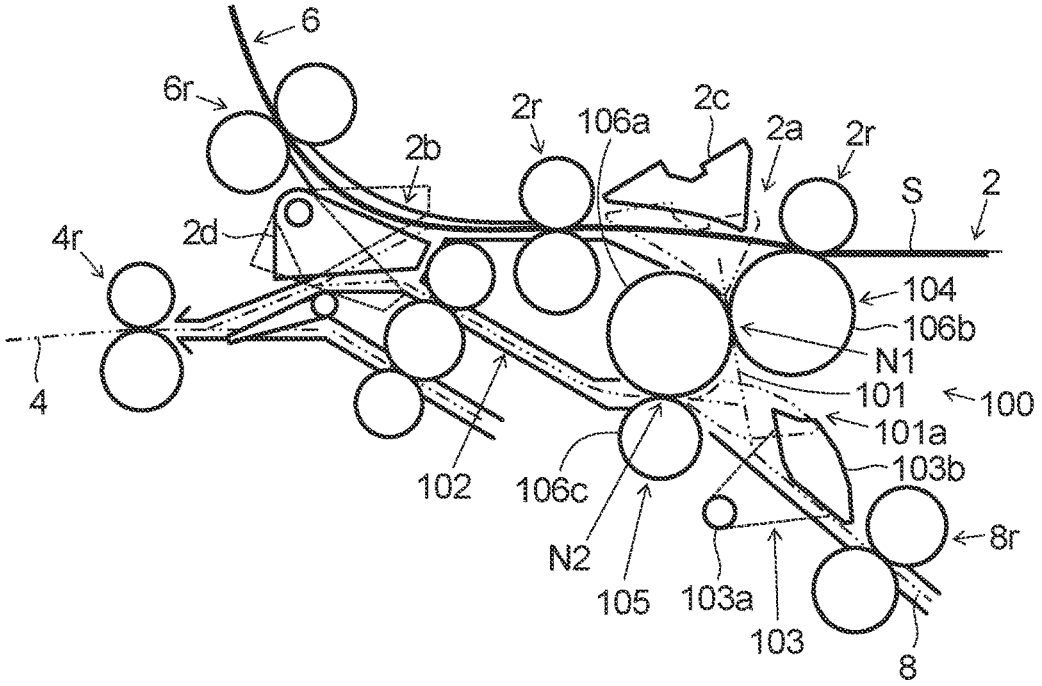
FIG. 4 is a sectional front view showing the sheet folding portion and its vicinity shown in FIG. 3, illustrating a first stage in the course of inward triple-folding processing for a sheet.
Figure 5:
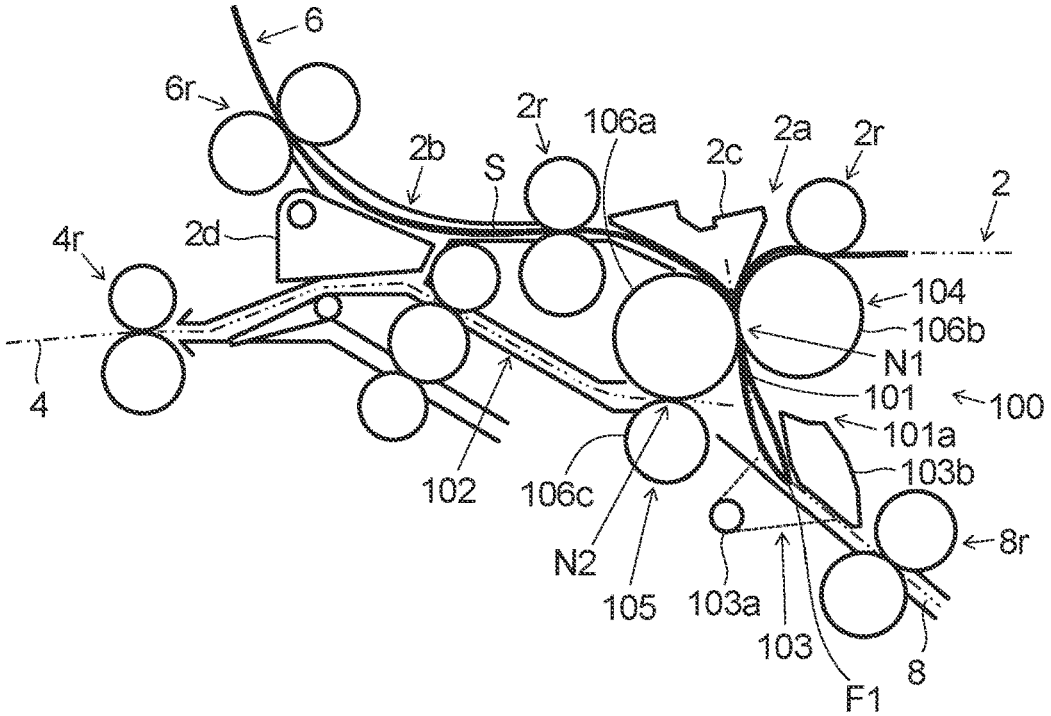
FIG. 5 is a sectional front view showing the sheet folding portion and its vicinity shown in FIG. 3, illustrating a second stage in the course of the inward triple-folding processing for a sheet.
Figure 6:
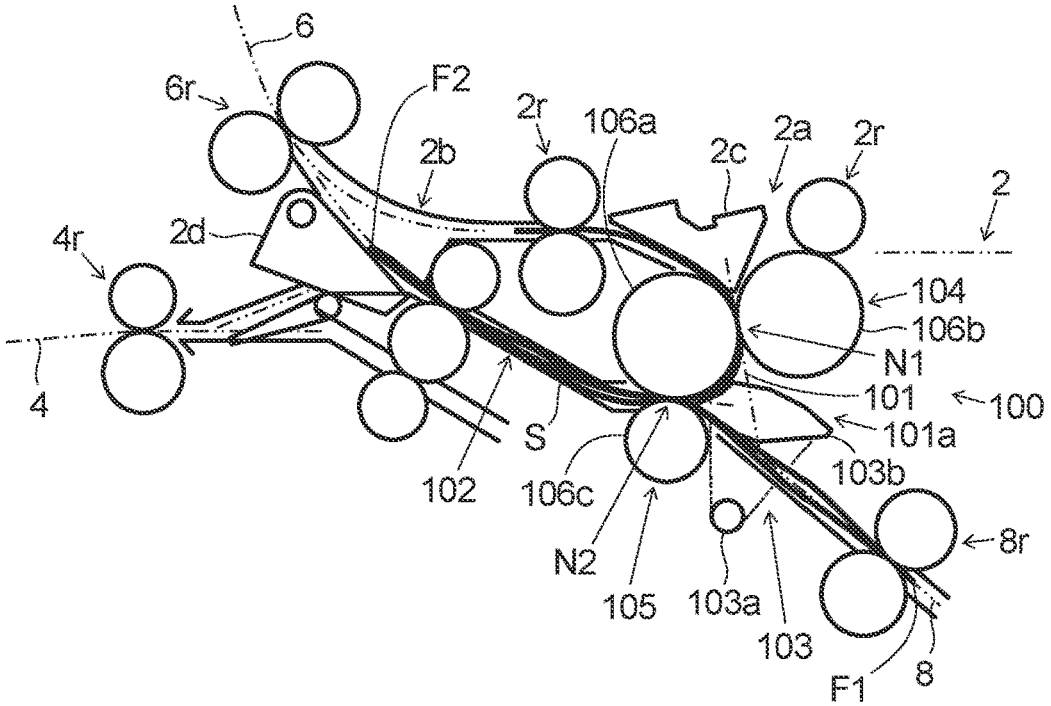
FIG. 6 is a sectional front view showing the sheet folding portion and its vicinity shown in FIG. 3, illustrating a third stage in the course of the inward triple-folding processing for a sheet.

Next, an operation of the sheet folding portion 100 will be described with reference to FIGS. 4, 5, and 6. FIGS. 4, 5, and 6 are sectional front views showing the sheet folding portion 100 and its vicinity shown in FIG. 3, respectively illustrating a first stage, a second stage, and a third stage in the course of inward triple-folding processing for a sheet S. The following description of the operation of the sheet folding portion 100 deals with, as an example, folding processing for inward triple folding as shown in FIG. 2C.

As shown in FIG. 4, when a sheet S is introduced through the sheet introduction port 2e (see FIG. 1) into the sheet introduction path 2, a downstream part of the sheet S in the sheet conveyance direction is guided via the second branching portion 2b to the second sheet discharge path 6. The second switching guide 2d of the second branching portion 2b switches the conveyance direction of the sheet S conveyed on the sheet introduction path 2 from the sheet introduction port 2e so as to guide the sheet S to the second sheet discharge path 6. The first switching guide 2c of the first branching portion 2a is retreated from the sheet introduction path 2 in a direction away from the first nip portion N1, that is, to a position above the sheet introduction path 2 in FIG. 4.

Subsequently, when part of the sheet S corresponding to a first fold F1 (see FIG. 2C) reaches the first branching portion 2a, the pairs of feed rollers 2r in the sheet introduction path 2 and the pairs of feed rollers 6r in the second sheet discharge path 6 are caused to stop rotating, so that the conveyance of the sheet S is stopped. Then, such one of the pairs of feed rollers 2r as is disposed, in the sheet introduction path 2, downstream of the first branching portion 2a (to the left of the first branching portion 2a in FIG. 4) in the sheet conveyance direction and the pairs of the feed rollers 6r in the second sheet discharge path 6 are caused to rotate reversely. Thereby, such part of the sheet S as is located downstream of the first branching portion 2a in the sheet conveyance direction moves upstream (rightward in FIG. 4), so that the sheet S is caused to sag at the first branching portion 2a.

Subsequently, the first switching guide 2c is moved in a direction toward the first nip portion N1 of the pair of first conveyance rollers 104, and makes contact with the sheet S. By making contact with the sheet S, the first switching guide 2c guides the sagging part of the sheet S to the first nip portion N1. Then, passing through the first nip portion N1, the sheet S has the first fold F1 formed therein as shown in FIG. 5.

The timing for forming the first fold F1 in the sheet S is determined in accordance with the timing with which a sheet sensor (unillustrated) detects, in the first sheet introduction path 2, a downstream end of the sheet S in the sheet conveyance direction, a length of the sheet S in the sheet conveyance direction, and a conveyance speed of the sheet S. This also applies to the timing for forming the second fold F2, which will be described later.

The folding blade 103 at the folding branching portion 101*a* is retreated from the first sheet conveyance path 101 in a direction away from the second nip portion N2, that is, to the right of the first sheet conveyance path 101 in FIG. 5.

After passing through the first nip portion N1, the sheet S is conveyed, starting with its part where the first fold F1 is formed, and with its two regions that extend along the sheet conveyance direction overlapped with each other, along the first sheet conveyance path 101 in a direction away from the first branching portion 2*a*. After passing through the first sheet conveyance path 101, an upstream part of the sheet S in the conveyance direction temporarily enters the third sheet discharge path 8.

Subsequently, when the part of the sheet S corresponding to the second fold F2 (see FIG. 2C) reaches the folding branching portion 101*a*, the pairs of feed rollers 2*r* in the sheet introduction path 2, the pairs of feed rollers 6*r* in the second sheet discharge path 6, the pair of first conveyance rollers 104, and the pairs of feed rollers 8*r* in the third sheet discharge path 8 are caused to stop rotating, so that the conveyance of the sheet S is stopped. Then, the pairs of feed rollers 8*r* in the third sheet discharge path 8 are caused to rotate reversely. As a result, such part of the sheet S as is located downstream of the folding branching portion 101*a* in the sheet conveyance direction (as is below the folding branching portion 101*a* in FIG. 5) moves upstream (upward in FIG. 5), so that the sheet S is caused to sag at the folding branching portion 101*a*.

Subsequently, the folding blade 103 is moved in a direction toward the second nip portion N2 of the pair of second conveyance rollers 105, and makes contact with the sheet S. By making contact with the sheet S, the folding blade 103 guides the sagging part of the sheet S to the second nip portion N2. Then, passing through the second nip portion N2, the sheet S has the second fold F2 formed therein as shown in FIG. 6.

After passing through the second nip portion N2, the sheet S is conveyed, starting with its part where the second fold F2 is formed, and with its three regions that extend along the sheet conveyance direction overlapped with each other, along the second sheet conveyance path 102 in a direction away from the pair of second conveyance rollers 105. After passing through the second sheet conveyance path 102, the sheet S enters the second sheet discharge path 6 via the second branching portion 2*b*, and is guided toward the second sheet discharge portion 5. Meanwhile, at the second branching portion 2*b*, the second switching guide 2*d* switches the conveyance direction of the sheet S having passed through the second sheet conveyance path 102 and reached the second branching portion 2*b* such that the sheet S is guided to the second sheet discharge path 6. The sheet S is guided to the second sheet discharge path 6, to be discharged through the second discharge port 51 onto the second discharge tray 53 (see FIG. 1).

Z-folding processing for Z-folding a sheet S (see FIG. 2A) and in outward triple-folding processing for outward triple-folding a sheet S (see FIG. 2B) can also be performed likewise, by changing the timing for forming the first fold F1 and for forming the second fold F2 in the sheet S, following the procedure described with reference to FIGS. 4, 5, and 6. Further, double-folding processing, quadruple-folding processing, etc. can also be performed likewise on a sheet S by changing the number of times of forming a fold and the timing for forming a fold.

Figure 7:
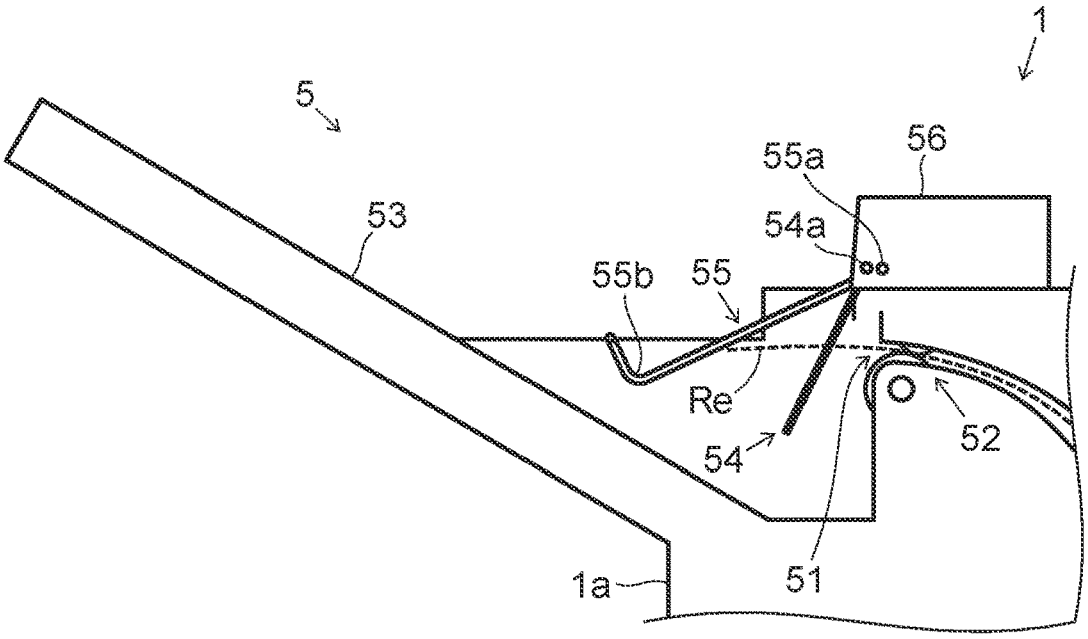
FIG. 7 is a partial sectional front view showing a second sheet discharge portion of the sheet post-processing device and its vicinity shown in FIG. 1.
Figure 8:
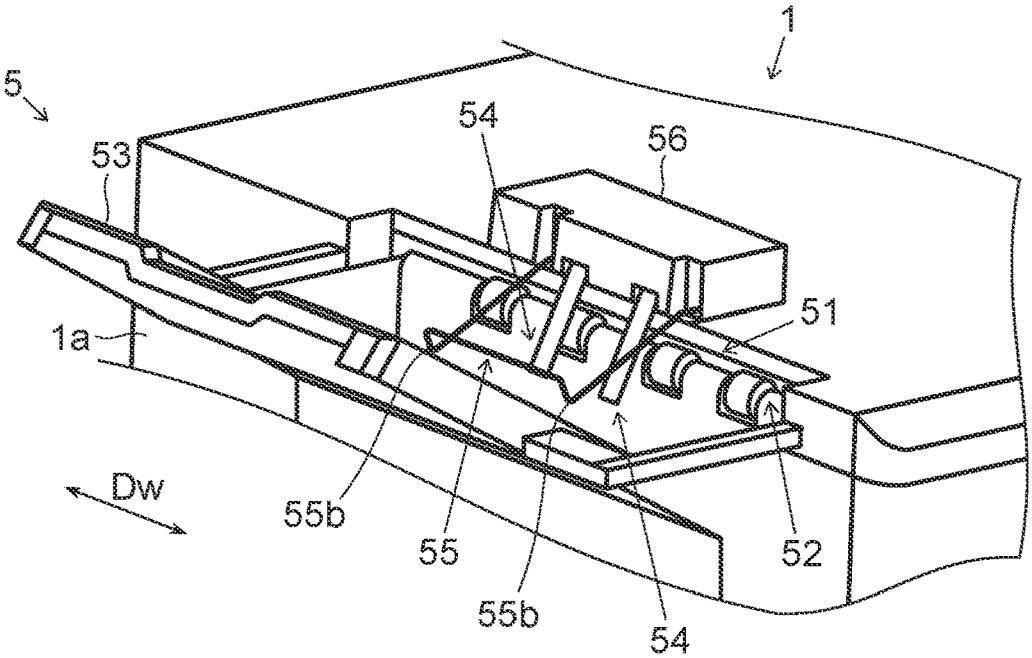
FIG. 8 is a perspective view of and around the second sheet discharge portion shown in FIG. 7.

Next, a configuration of the second sheet discharge portion 5 and its vicinity will be described with reference to FIGS. 7 and 8. FIG. 7 is a partial sectional front view showing the second sheet discharge portion 5 of the sheet post-processing device 1 and its vicinity shown in FIG. 1. FIG. 8 is a perspective view of and around the second sheet discharge portion 5 shown in FIG. 7. In FIG. 7, a discharge route Re for a sheet from the second discharge port 51 is depicted.

The second sheet discharge portion 5 has, in addition to the second discharge port 51, the pair of second discharge rollers 52, and the second discharge tray 53, a first sheet holding member 54, a second sheet holding member 55, and a holding-member driving portion (a driving portion) 56.

The second discharge tray 53 is connected to the side face 1*a* of the sheet post-processing device 1, below the second discharge port 51, and extends downstream in a sheet discharge direction in which a sheet S is discharged through the second discharge port 51. The second discharge tray 53 has an upward inclination toward the downstream side in the sheet discharge direction, that is, away from the side face 1*a* of the sheet post-processing device 1. Thus, a sheet discharged onto the second discharge tray 53 is gravitationally stacked so as to be close to the side face 1*a* of the sheet post-processing device 1, which is on an upstream side in the sheet discharge direction.

The first sheet holding member 54 is constituted of, for example, a sheet-shaped member extending parallel to the sheet discharge direction, having its one end part (base end part) in its longitudinal direction attached above the pair of second discharge rollers 52. The other end part (leading end part) of the first sheet holding member 54 in its longitudinal direction extends to below the pair of second discharge rollers 52 so as to face the second discharge tray 53 across a predetermined space above the second discharge tray 53. In the present embodiment, the first sheet holding member 54 is disposed at each of two side-by-side positions close to a center part in the sheet width direction. The first sheet holding member 54 makes contact with a downstream end of a folded sheet in the sheet discharge direction when the folded sheet is discharged through the second discharge port 51, and holds the folded sheet stacked on the second discharge tray 53 by the upstream end part of the folded sheet in its discharge direction.

The first sheet holding member 54 is attached above the pair of second discharge rollers 52 so as to be swingable about a rotation shaft 54*a* extending in the sheet width direction. The first sheet holding member 54 can swing by making contact with a folded sheet. That is, the first sheet holding member 54 swings corresponding to the number of folded sheets stacked on the second discharge tray 53.

The second sheet holding member 55 is constituted of, for example, a rod-shaped member extending parallel to the sheet discharge direction, having its one end part (base end part) in its longitudinal direction attached above the pair of second discharge rollers 52. The other end part (leading end part) of the second sheet holding member 55 in its longitudinal direction extends to below the pair of second discharge rollers 52, so as to, on a downstream side of the first sheet holding member 54 in the sheet discharge direction, face the second discharge tray 53 across a predetermined space above the second discharge tray 53. The second sheet holding member 55 makes contact with a folded sheet discharged through the second discharge port 51, and holds the folded sheet stacked on the second discharge tray 53 by a downstream part of the folded sheet in the discharge direction thereof. In the present embodiment, the second sheet holding member 55 makes contact with the folded sheet at a contact portion 55*b* thereof provided at each of two positions outward of the first sheet holding member 54 with respect to the sheet width direction.

The second sheet holding member 55 is attached above the pair of second discharge rollers 52 so as to be swingable about a rotation shaft 55*a* extending in the sheet width direction. The second sheet holding member 55 can swing by making contact with a folded sheet. That is, the second sheet holding member 55 swings corresponding to the number of folded sheets stacked on the second discharge tray 53.

Figure 9:
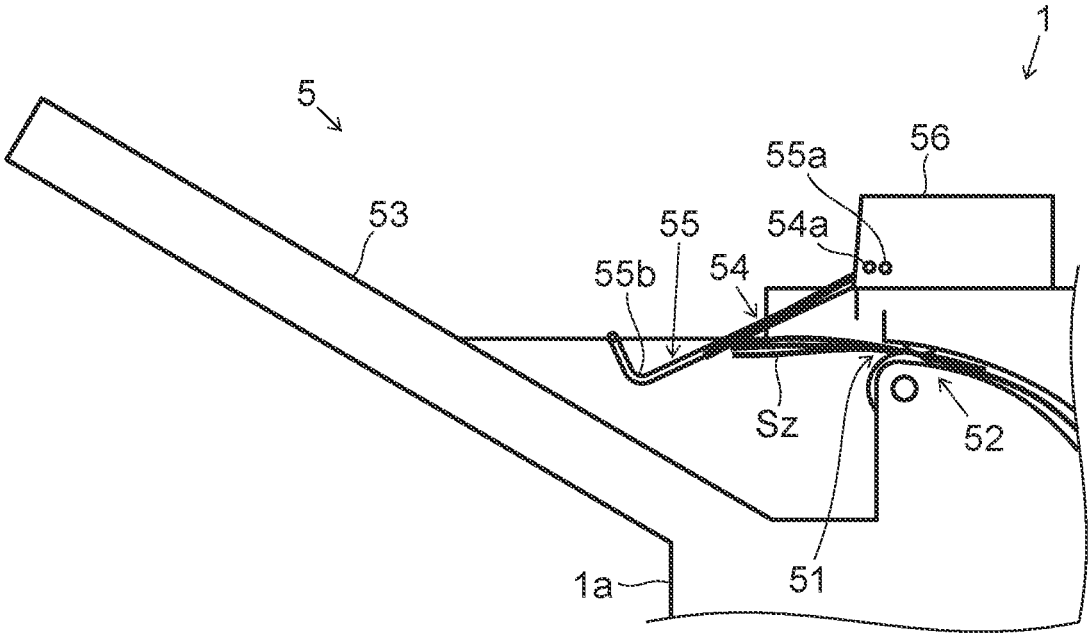
FIG. 9 is a partial sectional front view showing the second sheet discharge portion and its vicinity shown in FIG. 7, illustrating a state where a Z-folded sheet is being discharged.

FIG. 9 is a partial sectional front view showing the second sheet discharge portion 5 and its vicinity shown in FIG. 7, illustrating a state where a Z-folded sheet Sz is being discharged. For example, in a case of discharging a Z-folded sheet Sz onto the second sheet discharge portion 5, the first sheet holding member 54 and the second sheet holding member 55 are, on a downstream side of the pair of discharge rollers 52 in the discharge direction of the folded sheet, disposed at a holding position, at which the first sheet holding member 54 and the second sheet holding member 55 intersect a discharge route Re (see FIG. 7) for the folded sheet and extend downward from above the pair of discharge rollers 52 toward the second discharge tray 53 to hold the folded sheet (see FIGS. 7 and 9).

Note that FIG. 7 shows the first sheet holding member 54 and the second sheet holding member 55 located at the holding position, with no sheet being discharged. FIG. 9 shows a state after a Z-folded sheet Sz makes contact with the first sheet holding member 54 located at the holding position to cause the first sheet holding member 54 to swing toward the second sheet holding member 55.

Figure 10:
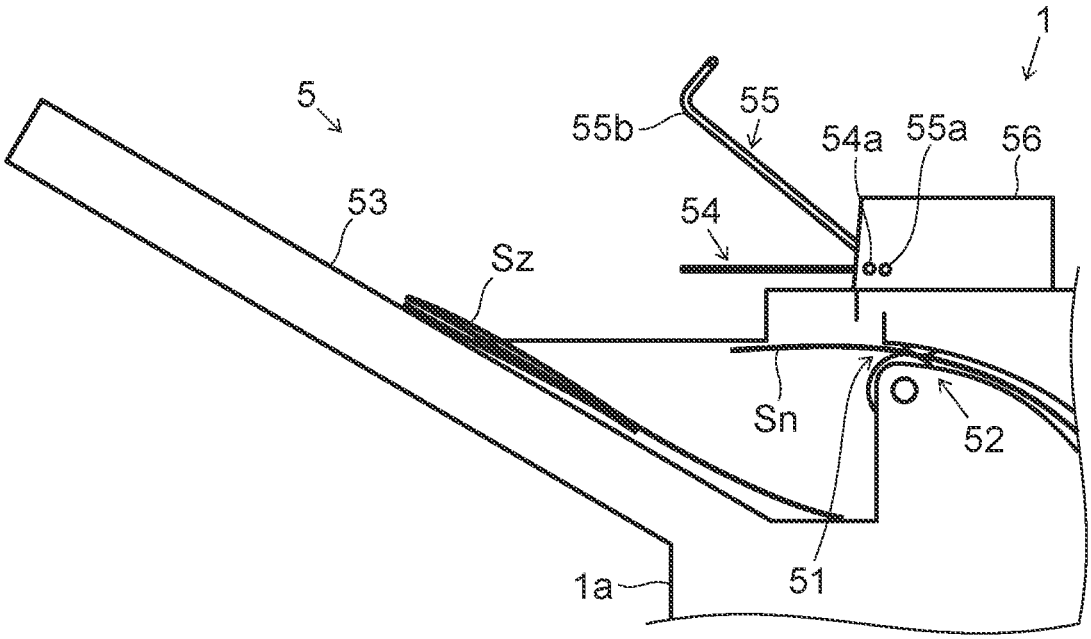
FIG. 10 is a partial sectional front view showing the second sheet discharge portion and its vicinity shown in FIG. 7, illustrating a state where a sheet not having been subjected to folding processing is being discharged.

FIG. 10 is a partial sectional front view showing the second sheet discharge portion 5 and its vicinity shown in FIG. 7, illustrating a state where a sheet not subjected to folding processing is being discharged. For example, in a case of discharging a sheet not subjected to the folding processing onto the second sheet discharge portion 5, the first sheet holding member 54 and the second sheet holding member 55 are, on the downstream side of the pair of discharge rollers 52 in the discharge direction of the folded sheet, disposed at a retreat position retreated to above the discharge route Re (see FIG. 7) for the folded sheet (see FIG. 10).

As in the configuration described above, the first sheet holding member 54 and the second sheet holding member 55 are selectively disposed at the holding position and the retreat position. The selective disposition may be done manually, or, as will be later described in the present embodiment, using power of a motor or the like.

According to the configuration described above, in a case where, for example, a sheet with low solidity (rigidity, stiffness) is discharged, the first sheet holding member 54 and the second sheet holding member 55 can be disposed at the retreat position. Thus, regardless of the types of sheets, it is possible to stack a large number of sheets on the second discharge tray 53 in an aligned manner.

The holding-member driving portion 56 is disposed above the pair of second discharge rollers 52. To the holding-member driving portion 56, the rotation shafts 54*a* and 55*a* of the first and second sheet holding members 54 and 55, respectively, are attached.

Figure 11:
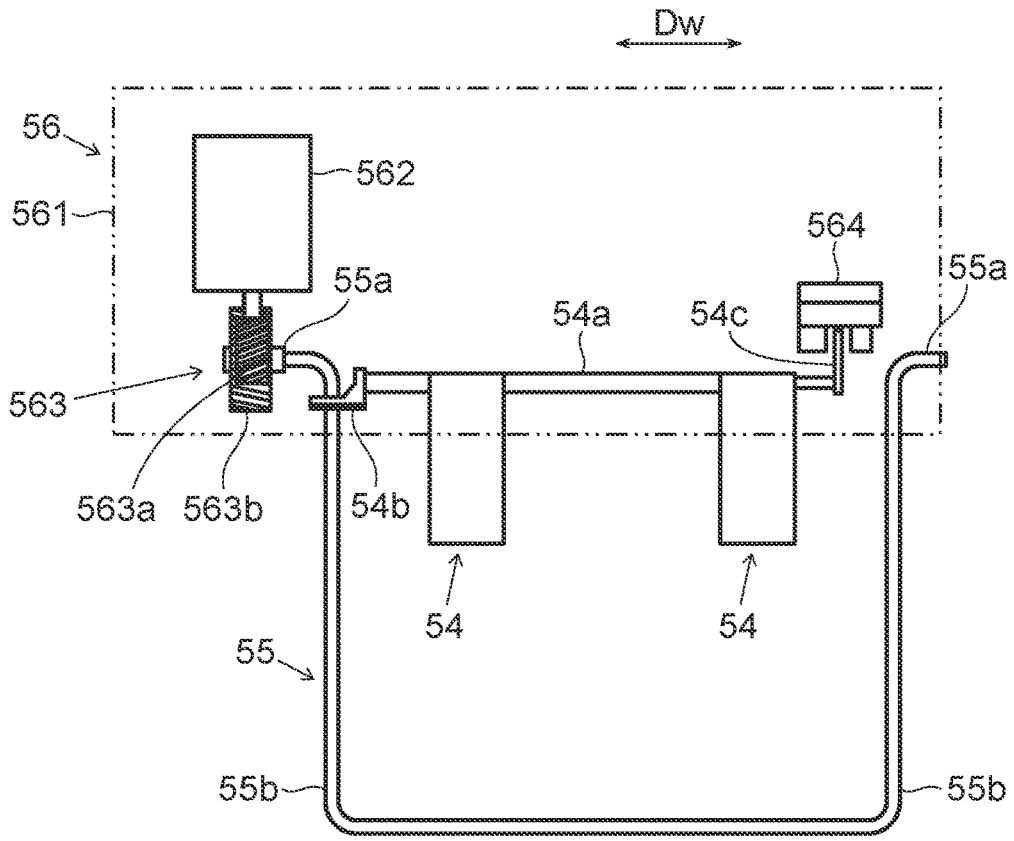
FIG. 11 is a top view of a holding-member driving portion (holding position) of the second sheet discharge portion shown in FIG. 7.
Figure 12:
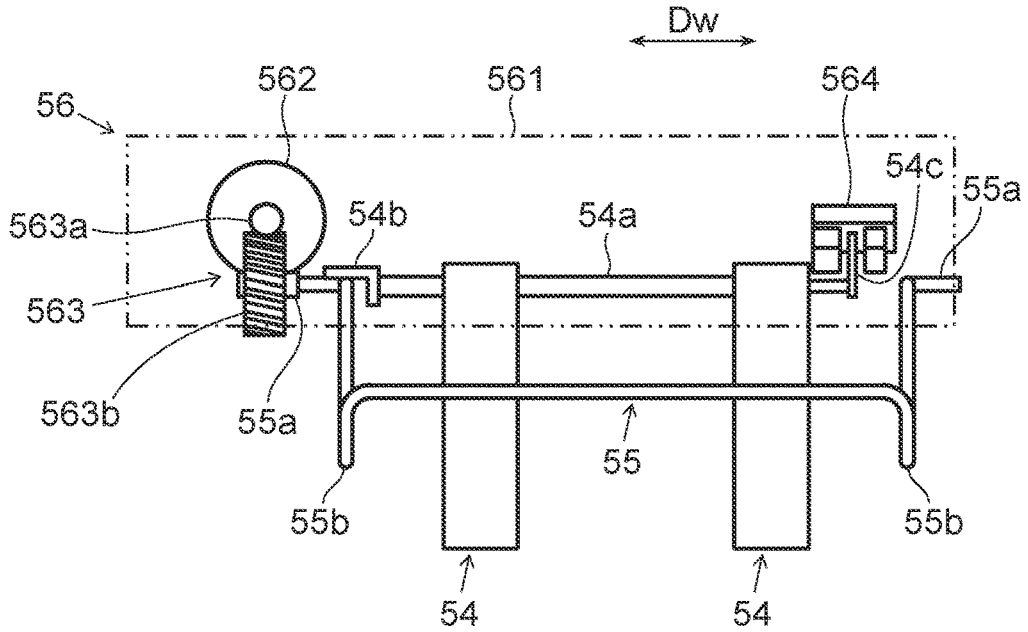
FIG. 12 is a side view of the holding-member driving portion (holding position) of the second sheet discharge portion shown in FIG. 7.
Figure 13:
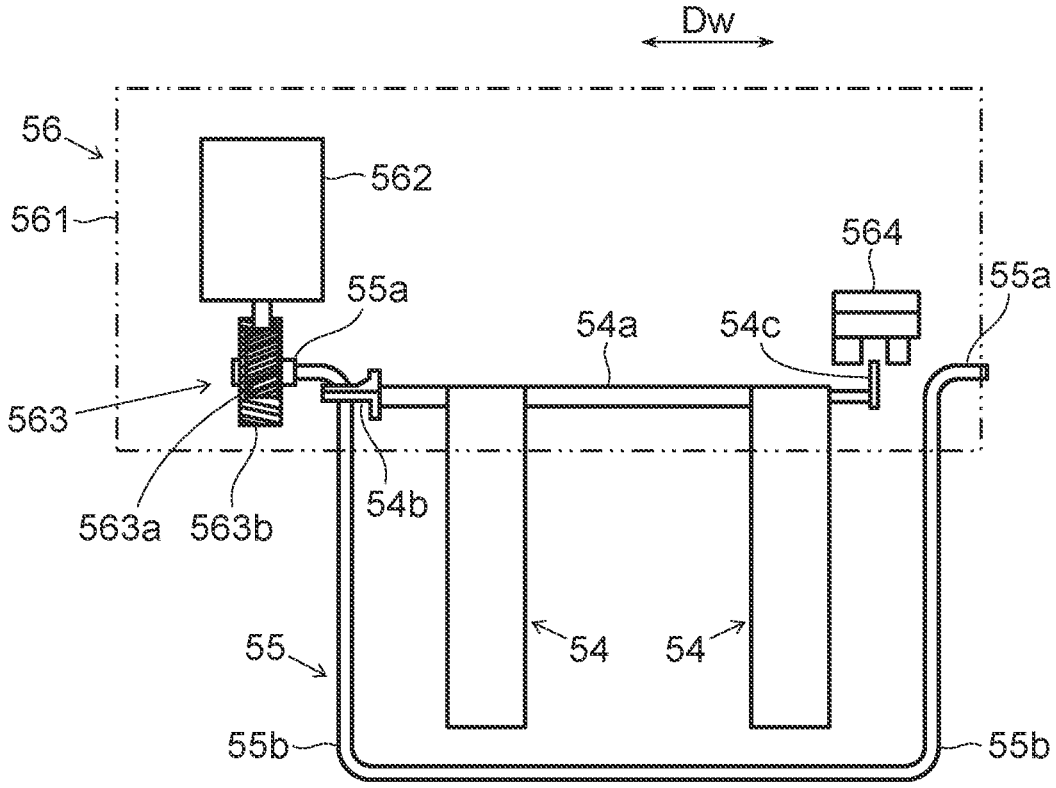
FIG. 13 is a top view of the holding-member driving portion (retreat position) of the second sheet discharge portion shown in FIG. 7.
Figure 14:
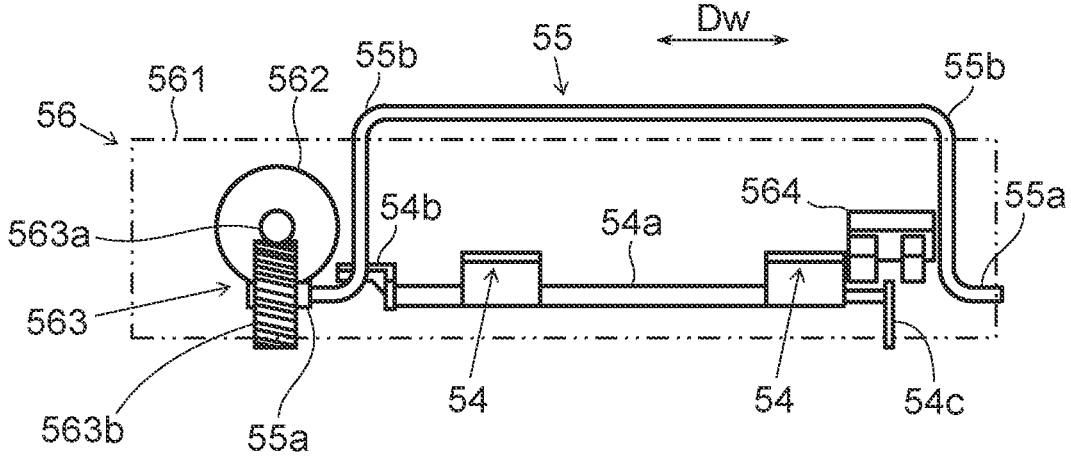
FIG. 14 is a side view of the holding-member driving portion (retreat position) of the second sheet discharge portion shown in FIG. 7.

FIGS. 11 and 12 are a top view and a side view, respectively, of the holding-member driving portion 56 (the holding position) of the second sheet discharge portion 5 shown in FIG. 7. FIGS. 13 and 14 are a top view and a side view, respectively, of the holding-member driving portion 56 (the retreat position) of the second sheet discharge portion 5 shown in FIG. 7. In each of FIGS. 11, 12, 13, and 14, an arrow Dw indicating the sheet width direction is depicted.

The holding-member driving portion 56 has a housing 561, a motor 562, a gear portion 563, and an angle detection portion 564.

The housing 561 is constituted in a shape of a substantially rectangular-parallelepiped hollow box, and houses therein the motor 562, the gear portion 563, and the angle detection portion 564. The housing 561 supports the first and second sheet holding members 54 and 55 so as to be swingable about the rotation shafts 54*a* and 55*a*, respectively, that extend in the sheet width direction Dw. One side face of the housing 561 faces a direction toward where the second discharge tray 53 (see FIGS. 7 and 8) is located, and the first sheet holding member 54 and the second sheet holding member 55 protrude beyond the side face toward the second discharge tray 53.

The motor 562 and the gear portion 563 are disposed inside the housing 561. The gear portion 563 includes a worm 563*a* and a worm wheel 563*b* that mesh with each other. To an output shaft of the motor 562, the worm 563*a* is fixed. The worm wheel 563*b* is connected to the rotation shaft 55*a* of the second sheet holding member 55. When the motor 562 is driven, via the gear portion 563, the second sheet holding member 55 rotates (swings) about the rotation shaft 55*a*.

The worm wheel 563*b* and the rotation shaft 55*a* of the second sheet holding member 55 are connected to each other via a one-way clutch, a toothless gear, or the like. As a result, the second sheet holding member 55 is disconnected from the motor 562 when the holding-member driving portion 56 is not driven, and thus no load is generated with respect to the swinging of the second sheet holding member 55 about the rotation shaft 55*a*. That is, the second sheet holding member 55 is swingable by making contact with a folded sheet discharged from the second discharge port 51, and swings corresponding to the number of folded sheets stacked on the second discharge tray 53.

In the present embodiment, the second sheet holding member 55 is constituted of one rod-shaped member bent at predetermined points. At each of opposite end parts of the second sheet holding member 55 in the sheet width direction, the rotation shaft 55*a* is formed which extends in the sheet width direction Dw and is supported by the housing 561. To one end part of the rotation shaft 55*a* of the second sheet holding member 55, the worm wheel 563*b* is connected which rotates about the rotation shaft 55*a*.

The second sheet holding member 55 has two contact portions 55*b* that are each continuous with the rotation shaft 55*a* and extend toward the second discharge tray 53 to make contact with a folded sheet. The two contact portions 55*b* are disposed on opposite sides outward of the first sheet holding member 54 with respect to the sheet width direction Dw. The contact portions 55*b* have their leading end parts, which make contact with a folded sheet, bent upward. The two contact portions 55*b* are connected to each other at a central part of the second sheet holding member 55 in the sheet width direction Dw.

The first sheet holding member 54 is, inside the housing 561, fixed to an outer circumferential part of the rotation shaft 54*a* extending in the sheet width direction Dw, and extends outward substantially in a radial direction of the rotation shaft 54*a*. The rotation shaft 54*a* of the first sheet holding member 54 is disposed, with respect to the sheet width direction Dw, inward of the rotation shaft 55*a* of each of the two positions in the second sheet holding member 55. The rotation shaft 54*a* is not directly connected to the holding-member driving portion 56. To the rotation shaft 54*a*, an engagement piece 54*b* and a light-shielding plate 54*c* are attached.

The engagement piece 54*b* is fixed to one end part of the rotation shaft 54*a*, the motor 562 and the gear portion 563 being disposed at the one end part. The engagement piece 54*b* is adjacent to the rotation shaft 55*a* of one end part of the second sheet holding member 55, and is located above the second sheet holding member 55. The second sheet holding member 55 is in contact and engagement with a lower surface of the engagement piece 54*b*. That is, the first sheet holding member 54 is in engagement with, and moves following, the second sheet holding member 55.

The light-shielding plate 54*c* is fixed to the other end part of the rotation shaft 54*a*, the other end part being opposite to the one end part at which the engagement piece 54*b* is provided. The light-shielding plate 54*c* extends outward in the radial direction of the rotation shaft 54*a*. When the rotation shaft 54*a* rotates, the light-shielding plate 54*c* enters, or retreats from, an optical path of a later-described optical sensor of the angle detection portion 564.

The angle detection portion 564 is disposed in a region that is, with respect to the sheet width direction Dw, opposite to the region where the motor 562 and the gear portion 563 are disposed, across the rotation shaft 54*a* of the first sheet holding member 54. The angle detection portion 564 includes a transmissive optical sensor, for example, and has an optical path that extends, along the sheet width direction Dw, from a light emitting portion toward a light receiving portion. The light-shielding plate 54*c* enters and retreats from the optical path of the angle detection portion 564.

For example, as shown in FIGS. 11 and 12, when the first sheet holding member 54 and the second sheet holding member 55 are disposed at the holding position, the light-shielding plate 54*c* enters the optical path of the angle detection portion 564 to block the optical path. Further, as shown in FIGS. 13 and 14, when the first sheet holding member 54 and the second sheet holding member 55 are disposed at the retreat position, the light-shielding plate 54*c* retreats from the optical path of the angle detection portion 564 to unblock the optical path.

In this manner, the angle detection portion 564 detects a rotation angle of the rotation shaft 54*a*. In other words, since the first sheet holding member 54 is in engagement with the second sheet holding member 55, the angle detection portion 564 detects a swing angle of the first sheet holding member 54 and the second sheet holding member 55.

The holding-member driving portion 56 is controlled by the post-processing control portion 12, and shifts the first sheet holding member 54 and the second sheet holding member 55 between the holding position and the retreat position. Specifically, in a case where a folded sheet is discharged through the second discharge port 51, the post-processing control portion 12 disposes the first sheet holding member 54 and the second sheet holding member 55 at the holding position. Further, in a case where a sheet not subjected to the folding processing is discharged through the second discharge port 51, the post-processing control portion 12 disposes the first sheet holding member 54 and the second sheet holding member 55 at the retreat position.

According to the configuration described above, the first sheet holding member 54 and the second sheet holding member 55 can be disposed at the holding position or the retreat position automatically depending on the type of a sheet discharged onto the second sheet discharge portion 5. Thus, it is possible to more efficiently stack a large number of sheets on the second discharge tray 53 in an aligned manner.

Further, based on the angle of the first and second sheet holding members 54 and 55 detected by the angle detection portion 564, the post-processing control portion 12 disposes the first sheet holding member 54 and the second sheet holding member 55 at the holding position or the retreat position.

According to this configuration, it is possible, by means of the angle detection portion 564, to appropriately detect the swing angle of the first sheet holding member 54 and the second sheet holding member 55. This makes it possible to improve the accuracy in the positioning of the first sheet holding member 54 and the second sheet holding member 55 with respect to the holding position and the retreat position. Thus, it is possible to enhance the effect of stacking a large number of sheets on the second discharge tray 53 in an aligned manner.

Further, the second sheet holding member 55 is connected to the holding-member driving portion 56, and is caused by the holding-member driving portion 56 to reciprocate between the holding position and the retreat position. The first sheet holding member 54, by engaging with and moving following the second sheet holding member 55, reciprocates between the holding position and the retreat position. Here, the first sheet holding member 54 may be connected to the holding-member driving portion 56 to reciprocate between the holding position and the retreat position, and the second sheet holding member 55 may be engaged with and moved following the first sheet holding member 54 to thereby reciprocate between the holding position and the retreat position.

According to the configuration described above, the holding-member driving portion 56 may be connected to just one of the first sheet holding member 54 and the second sheet holding member 55, and this makes the configuration a simpler and more convenient configuration. Further, it is possible to allow the first sheet holding member 54 and the second sheet holding member 55 to behave independently of each other on making contact with a folded sheet. That is, it is possible to allow the first sheet holding member 54 and the second sheet holding member 55 to each exert individual effects.

Further, the two contact portions 55*b* of the second sheet holding member 55 respectively make contact with a folded sheet at opposite end sides of the folded sheet in the sheet width direction. The first sheet holding member 54 makes contact with a folded sheet at a position that is inward, in the sheet width direction, of the contact portions 55*b* which are disposed on opposite end sides of the second sheet holding member 55 and make contact with the folded sheet.

According to the configuration described above, it is possible to allow the first sheet holding member 54 to make contact with more types of sheets to stack them on the second discharge tray 53 in an aligned manner. Further, it is possible to allow the second sheet holding member 55 to make contact with sheets of a relatively large size at parts of the sheets near downstream parts thereof in the sheet discharge direction. That is, it is possible to suppress curling and the like occurring in downstream parts of sheets in the sheet discharge direction, and thus to stack the sheets on the second discharge tray 53 in an aligned manner.

The above-described embodiments are by no means meant to limit the scope of the present disclosure, and various modifications can be made and implemented within the scope not departing from the gist of the present disclosure.

What is claimed is:

1. A sheet post-processing device, comprising:

a discharge port having a pair of discharge rollers that discharge a sheet including a folded sheet subjected to folding processing;

a discharge tray on which the sheet discharged through the discharge port is stacked;

a first sheet holding member that is attached above the pair of discharge rollers and that holds the folded sheet stacked on the discharge tray by an upstream part of the folded sheet in a discharge direction of the folded sheet; and a second sheet holding member that is attached above the pair of discharge rollers and that holds the folded sheet stacked on the discharge tray by a downstream part of the folded sheet in the discharge direction of the folded sheet, wherein the first sheet holding member and the second sheet holding member are, on a downstream side of the pair of discharge rollers in the discharge direction of the folded sheet, selectively disposed at a holding position, at which the first sheet holding member and the second sheet holding member intersect a discharge route for the folded sheet and extend downward from above the pair of discharge rollers toward the discharge tray to hold the folded sheet, and at a retreat position retreated to above the discharge route for the folded sheet, the sheet post-processing device further comprising:

a driving portion that shifts the first sheet holding member and the second sheet holding member to the holding position and the retreat position; and a control portion that controls operation of the pair of discharge rollers and the driving portion, wherein the control portion disposes the first sheet holding member and the second sheet holding member at the holding position in a case where the folded sheet is discharged through the discharge port, and disposes the first sheet holding member and the second sheet holding member at the retreat position in a case where the sheet not subjected to the folding processing is discharged through the discharge port.

2. The sheet post-processing device according to claim 1, wherein the first sheet holding member and the second sheet holding member are attached above the pair of discharge rollers so as to be swingable about a rotation shaft extending in a sheet width direction orthogonal to the discharge direction of the folded sheet, an angle detection portion is provided which detects an angle of swing of the first sheet holding member and the second sheet holding member, and the control portion, based on an angle of the first sheet holding member and the second sheet holding member detected by the angle detection portion, disposes the first sheet holding member and the second sheet holding member at the holding position or the retreat position.

3. The sheet post-processing device according to claim 1, wherein one of the first sheet holding member and the second sheet holding member is connected to the driving portion and is caused by the driving portion to reciprocate between the holding position and the retreat position, and an other of the first sheet holding member and the second sheet holding member is in engagement with, and moves following, the one of the first sheet holding member and the second sheet holding member, thereby to reciprocate between the holding position and the retreat position.

4. The sheet post-processing device according to claim 1, wherein the second sheet holding member makes contact with the folded sheet on each of opposite sides of the folded sheet in a sheet width direction orthogonal to the discharge direction of the folded sheet, and the first sheet holding member makes contact with the folded sheet at a position that is inward, in the sheet width direction, of contact portions of the second sheet holding member which make contact with the folded sheet on each of the opposite sides of the folded sheet in the sheet width direction.

* * * * *